US010753191B2

(12) United States Patent
Tegeler et al.

(10) Patent No.: US 10,753,191 B2
(45) Date of Patent: Aug. 25, 2020

(54) DOWNHOLE TOOLS WITH POWER UTILIZATION APPARATUS DURING FLOW-OFF STATE

(71) Applicants: Sebastian Tegeler, Hannover (DE); Ole-Hendrik Ohlendorf, Hannover (DE); Matthias Gatzen, Isernhagen (DE); Frank Wiese, Lachendorf (DE); Andre Koenecke, Nienhagen (DE); Marius Kluge, Hannover (DE); Falko Beulshausen, Hannover (DE)

(72) Inventors: Sebastian Tegeler, Hannover (DE); Ole-Hendrik Ohlendorf, Hannover (DE); Matthias Gatzen, Isernhagen (DE); Frank Wiese, Lachendorf (DE); Andre Koenecke, Nienhagen (DE); Marius Kluge, Hannover (DE); Falko Beulshausen, Hannover (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/195,323

(22) Filed: Jun. 28, 2016

(65) Prior Publication Data

US 2017/0370202 A1 Dec. 28, 2017

(51) Int. Cl.
*E21B 44/00* (2006.01)
*E21B 41/00* (2006.01)
(Continued)

(52) U.S. Cl.
CPC ..... *E21B 44/005* (2013.01); *E21B 41/0085* (2013.01); *E21B 47/00* (2013.01);
(Continued)

(58) Field of Classification Search
CPC ..... E21B 47/12; E21B 47/18; E21B 41/0085; E21B 44/005; E21B 47/182; E21B 47/185; E21B 47/187
See application file for complete search history.

(56) References Cited

U.S. PATENT DOCUMENTS 4,941,951 A 7/1990 Sheppard et al.
7,928,605 B2 4/2011 Williams
(Continued)

FOREIGN PATENT DOCUMENTS

WO 2013126863 A1 8/2013
WO 2014193606 A1 12/2014
WO 2015076804 A1 5/2015

OTHER PUBLICATIONS

PCT International Search Report and Written Opinion; International Application No. PCT/US2017/039445; International Filing Date: Jun. 27, 2017; dated Oct. 30, 2017; pp. 1-14.

*Primary Examiner* — Robert E Fuller
*Assistant Examiner* — Lamia Quaim
(74) *Attorney, Agent, or Firm* — Cantor Colburn LLP

(57) ABSTRACT

A drilling assembly for use in drilling of a wellbore is disclosed that in one non-limiting embodiment includes a device that detects a flow-off state, a power generator that generates electrical energy in response to a fluid flowing through the drilling assembly during the flow-off state, and a circuit that utilizes such power to perform one or more selected operations in response to the detection of the flow-off state, including, but not limited to, storing data in a memory; shutting certain devices in the drilling assembly and parking a device in a desired position.

18 Claims, 3 Drawing Sheets

Figure 1:
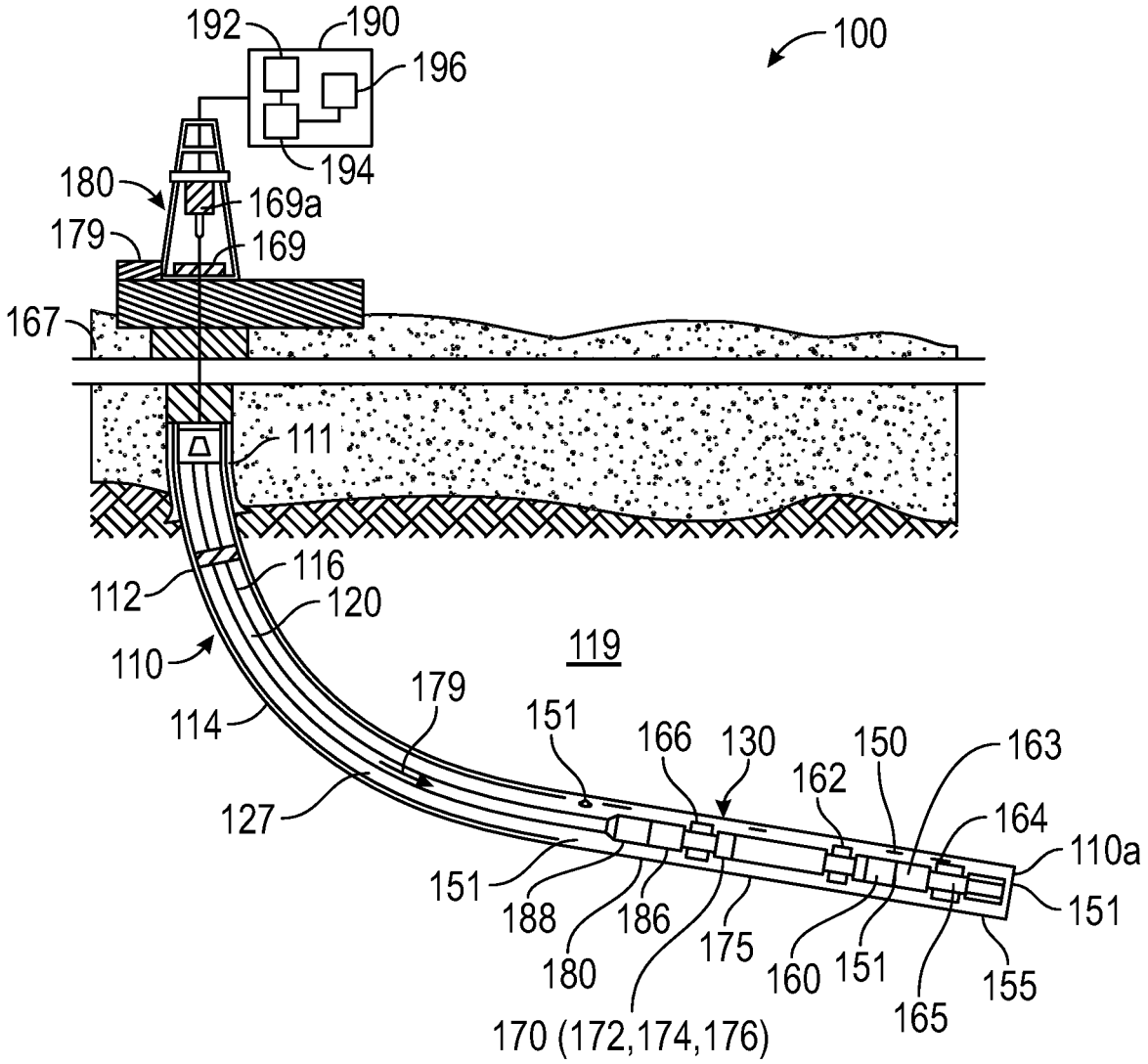

(51) Int. Cl.

| | |
|---|---|
| ***E21B 47/00*** | (2012.01) |
| ***E21B 47/18*** | (2012.01) |
| *E21B 3/04* | (2006.01) |
| *E21B 7/04* | (2006.01) |
| *E21B 17/10* | (2006.01) |

(52) U.S. Cl.
CPC ..... *E21B 47/18* (2013.01); *E21B 3/04* (2013.01); *E21B 7/04* (2013.01); *E21B 17/1078* (2013.01)

(56) References Cited

U.S. PATENT DOCUMENTS

| | | | | |
|---|---|---|---|---|
| 8,033,328 | B2 | 10/2011 | Hall et al. | |
| 9,133,668 | B2 | 9/2015 | Cardellini et al. | |
| 2010/0108306 | A1* | 5/2010 | Cooper | E21B 47/011 166/65.1 |
| 2014/0240140 | A1 | 8/2014 | Switzer et al. | |
| 2014/0240141 | A1* | 8/2014 | Logan | E21B 47/122 340/854.6 |
| 2014/0345940 | A1 | 11/2014 | Milner et al. | |
| 2014/0367168 | A1* | 12/2014 | Miller | E21B 47/01 175/40 |
| 2015/0107824 | A1 | 4/2015 | Signorelli et al. | |
| 2015/0136488 | A1 | 5/2015 | Khaled et al. | |
| 2015/0192488 | A1 | 7/2015 | Bin et al. | |
| 2015/0218913 | A1 | 8/2015 | Cooley et al. | |
| 2015/0275656 | A1* | 10/2015 | Holt | E21B 47/12 340/855.4 |
| 2016/0003007 | A1* | 1/2016 | Liu | H02J 7/00 166/250.01 |
| 2016/0003035 | A1 | 1/2016 | Logan et al. | |
| 2016/0010407 | A1 | 1/2016 | McCraw | |
| 2016/0010449 | A1* | 1/2016 | Liu | E21B 47/187 166/250.01 |
| 2016/0017693 | A1 | 1/2016 | Winslow et al. | |
| 2016/0340987 | A1* | 11/2016 | Prammer | E21B 19/16 |

* cited by examiner

DOWNHOLE TOOLS WITH POWER UTILIZATION APPARATUS DURING FLOW-OFF STATE

BACKGROUND

1. Field of the Disclosure

The disclosure herein relates generally to drilling of wellbores and particularly to managing power during flow-off states.

2. Background

Wells or wellbores are formed for the production of hydrocarbons (oil and gas) from subsurface formations. To drill a wellbore, a drilling assembly (also referred to as a bottomhole assembly or "BHA") is conveyed into the wellbore via a tubular from the surface. The drilling assembly includes sensors and tools that provide information about various parameters of interest about the formation surrounding the drilling assembly and drilling parameters that aid drilling of the wellbores along desired well paths. A drill bit attached at the bottom of the drilling assembly is rotated to disintegrate the formation to thus form the wellbore. During drill bit rotation, a drilling fluid is supplied under pressure into the tubular, which fluid discharges at the drill bit bottom and circulates to the surface via spacing (annulus) between the drill sting and the wellbore. The returning fluid carries the rock pieces disintegrated by the drill bit to the surface. The drilling assembly includes a power generation unit that generates power due to the flow of the drilling fluid through the drilling assembly. A typical power unit includes a turbine that is rotated by the fluid flow and a generator operated by the turbine to generate the electrical energy. The electrical energy generated downhole is utilized to operate the various sensors, tools and other electronic circuits in the drilling assembly. A pulser operated by the flow of the fluid through the drilling assembly is often utilized to telemeter signals from the drilling assembly to a surface controller in the form of pressure pulses. Various memory devices are utilized in the drilling assembly to store data obtained during drilling.

In modern drilling assemblies, copious amount of data is collected, processed and stored in a downhole memory system that may include a central or main memory and other memories associated with specific tools. During drilling of a wellbore, the flow of the drilling fluid is often shut off by shutting off mud pumps at the surface for a variety of reasons, including, but not limited to, prior to tripping the drilling assembly to add pipe sections. When the mud pumps are shut off, the drilling fluid continues to flow through the turbine for a period and thus generating power during such time, referred herein as the "flow-off state" or the "flow-off period." The power generated during the flow-off state is referred herein as the "residual power," which remains available to perform useful operations or functions. In the current systems, upon flow shut off, the system shuts down. Only a few circuits are designed for emergency power down mode, but do not include a system-wide operating procedure during flow-off states. Such systems do not detect the flow-off states, include any dedicated operating procedure or mode during flow-off state or optimally utilize the residual power during the flow-off states. In such an environment, memory devices may not be able to write all the data in the queue for storage or a controller downhole might not be able to perform certain functions, such as parking a device in a desired position or mode. Any signal sent from the surface to warn the downhole controllers that the flow-off has been activated can require more time to reach the downhole controller than the flow-off period, particularly for drilling systems utilizing mud-pulse telemetry.

The disclosure herein provides a system and methods for early detection of flow-off states and performing desired functions or operations during such flow-off states utilizing the residual power.

SUMMARY

In one aspect, a drilling assembly for use in drilling of a wellbore is disclosed that in one non-limiting embodiment includes a detection device that detects a flow-off state, a power generator that generates electrical energy in response to a fluid flowing through the drilling assembly during the flow-off state, and a device that utilizes such power to perform one or more selected operations in response to the detection of the flow-off state. In one aspect, the system causes proper storage of data and parks one or more devices in the respective desired positions.

In another aspect, a method of forming a wellbore is disclosed that in one non-limiting embodiment includes: conveying a drilling assembly into the wellbore that includes a power generator that generates power due to the flow of a circulating drilling fluid; turning off the fluid flow; detecting downhole the occurrence of the turning off of the fluid flow (flow-off state); operating one or more devices in response to the detection of the flow-off state. In one embodiment, operating one or more devices includes powering off to selected tools in the drilling assembly, causing memory devices in the drilling assembly to complete their respective write cycles and parking one or more devices in their desired positions during the flow off state.

Examples of the certain features of an apparatus and methods have been summarized rather broadly in order that the detailed description thereof that follows may be better understood, and in order that the contributions to the art may be appreciated. There are, of course, additional features that will be described hereinafter and which will form the subject of the claims.

DRAWINGS

Figure 2:
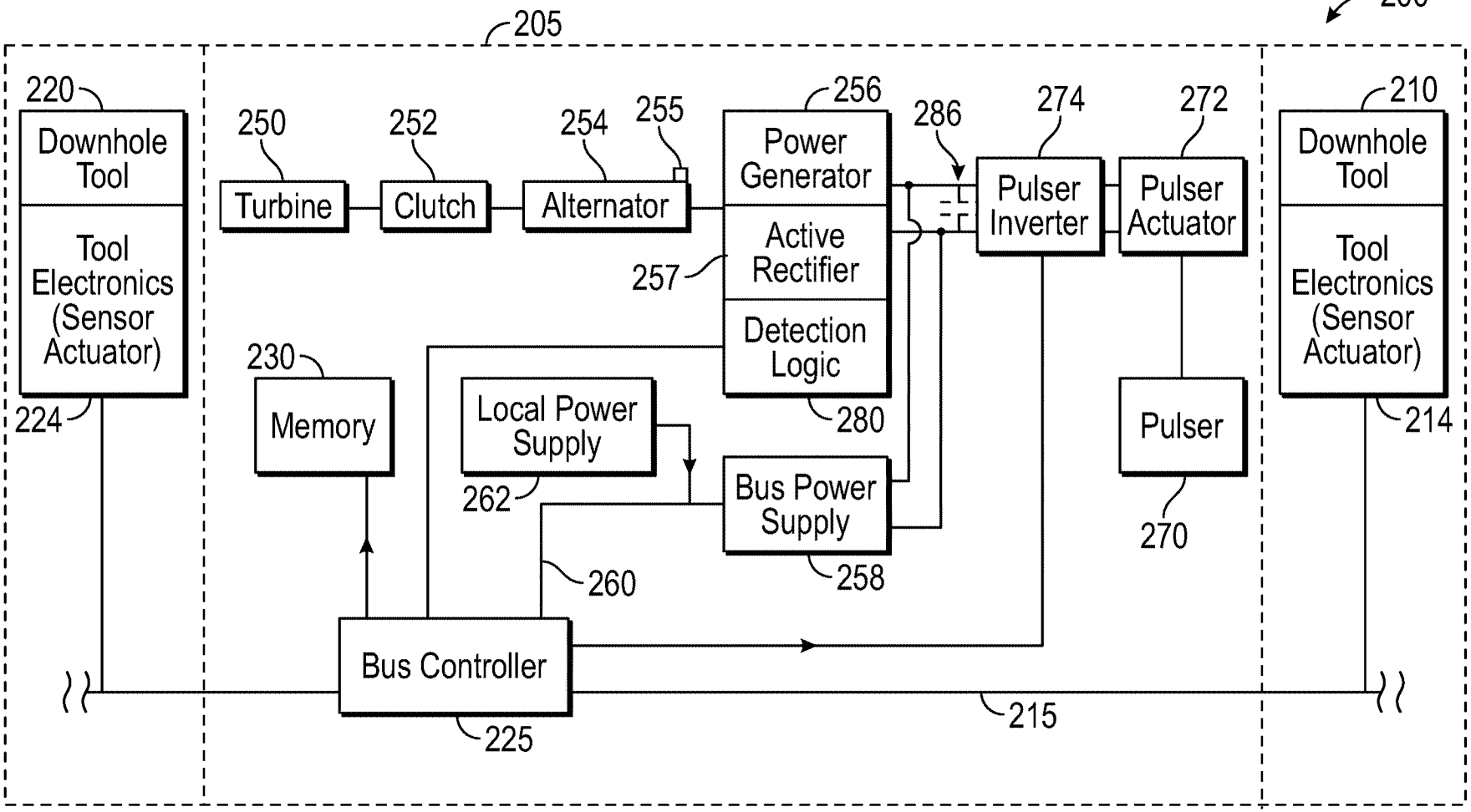
Figure 3:
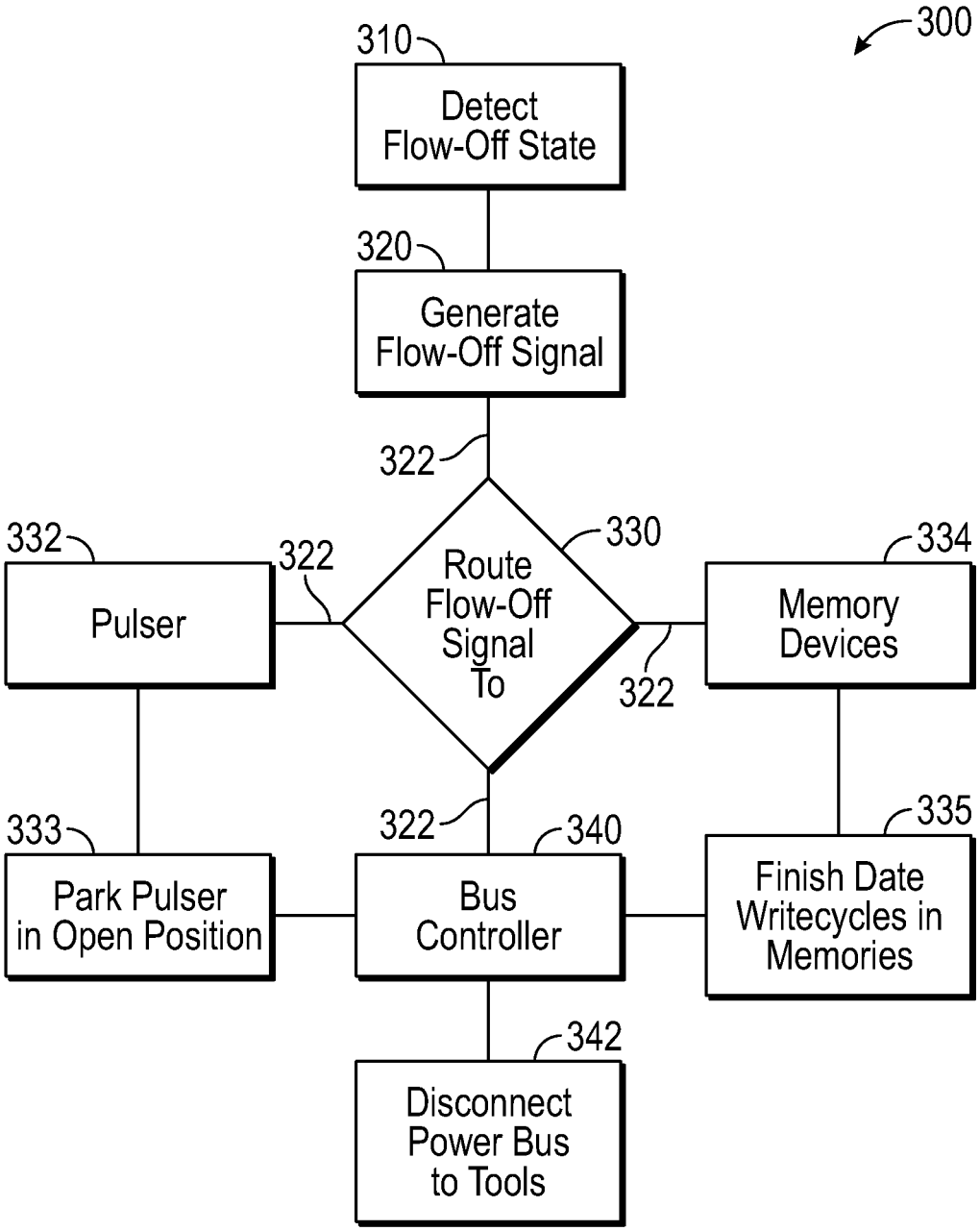

For a detailed understanding of the apparatus and methods disclosed herein, reference should be made to the accompanying drawings and the detailed description thereof, wherein like elements are generally given same numerals and wherein:

FIG. 1 shows a schematic diagram of an exemplary drilling system that includes apparatus for early detection of flow-off states and utilizing residual power to perform selected functions during such flow-off states;

FIG. 2 shows an exemplary block diagram of certain components of drilling assembly that includes exemplary circuits and devices for early detection of flow-off states and for utilizing the residual power to perform selected functions; and FIG. 3 shows a flow chart depicting an exemplary process relating to the detection of a flow-off state and performing certain dedicated functions during such flow-off state using at least in part the residual energy.

DETAILED DESCRIPTION

FIG. 1 is a schematic diagram of an exemplary drilling system 100 that includes a system for detecting flow-off states and utilizing residual energy for performing selected functions. The drilling system 100 is shown to include a wellbore 110 (also referred to as a "borehole" or "well") being formed in a formation 119 that includes an upper wellbore section 111 with a casing 112 installed therein and a lower wellbore section 114 being drilled with a drill string 120. The drill string 120 includes a tubular member 116 that carries a drilling assembly 130 (also referred to as the "bottomhole assembly" or "BHA") at its bottom end. The drilling tubular 116 may be a drill pipe made up by joining pipe sections. The drilling assembly includes a drill bit 155 attached to its bottom end and includes a number of devices and sensors, as described below. The drilling assembly 130 includes a steering unit 150 (also referred to as the steering section or steering assembly) for drilling deviated wellbores, a methodology often referred to in the art as geosteering. The steering unit 150, in one non-limiting embodiment, includes a number of expandable members 160 that apply selected forces on the wellbore wall for drilling directional wellbores.

Still referring to FIG. 1, the drill string 120 is shown conveyed into the wellbore 110 from an exemplary rig 180 at the surface 167. The exemplary rig 180 in FIG. 1 is shown as a land rig for ease of explanation. The apparatus and methods disclosed herein may also be utilized with offshore rigs. A rotary table 169 or a top drive 169*a* coupled to the drill string 118 may be utilized to rotate the drill string 120 and the drilling assembly 130. A control unit (also referred to as a "controller" or "surface controller") 190, which may be a computer-based system, at the surface 167 may be utilized for receiving and processing data transmitted by various sensors and tools (described later) in the drilling assembly 130 and for controlling selected operations of the various devices and sensors in the drilling assembly 130. The surface controller 190 may include a processor 192, a data storage device (or a computer-readable medium) 194 for storing data and computer programs 196 accessible to the processor 192 for determining various parameters of interest during drilling of the wellbore 110 and for controlling selected operations of the various tools in the drilling assembly 130 and those of drilling of the wellbore 110. The data storage device 194 may be any suitable device, including, but not limited to, a read-only memory (ROM), a random-access memory (RAM), a flash memory, a magnetic tape, a hard disc and an optical disk. To drill wellbore 110, a drilling fluid 179 is pumped under pressure into the tubular member 116, by mud pumps at the surface (not shown), which fluid passes through the drilling assembly 130 and discharges at the bottom 110*a* of the drill bit 155. The drill bit 155 disintegrates the formation rock into cuttings 151. The drilling fluid 179 returns to the surface 167 along with the cuttings 151 via the annular space (also referred as the "annulus") 127 between the drill string 120 and the wellbore 110.

Still referring to FIG. 1, the drilling assembly 130 may further include one or more downhole sensors (also referred to as the measurement-while-drilling (MWD) sensors and logging-while-drilling (LWD) sensors or tools, collectively referred to as downhole devices and designated by numeral 175, and at least one control unit or controller 170 for processing data received from the sensors 175. The downhole devices 175 may include sensors for providing measurements relating to various drilling parameters, including, but not limited to, vibration, whirl, stick-slip, flow rate, pressure, temperature, and weight-on-bit. The drilling assembly 130 further may include tools, including, but not limited to, a resistivity tool, an acoustic tool, a gamma ray tool, a nuclear tool and a nuclear magnetic resonance tool. Such devices are known in the art and are thus not described herein in detail. During a drilling process, drilling fluid flow is periodically cut off by stopping the mud pumps for a variety of reasons, including the tripping out of the drilling assembly 120 or to add pipe sections. Once the mud pumps are shut off, the drilling fluid still circulated through the drill string for a period of time. Such a situation is referred to herein as a "flow-off state" or "flow-off period." The drilling assembly 130 also includes a power and telemetry sub or system 180 that may include: a power generation device 186 in response to the flow of the drilling fluid 179 through the drilling assembly 130; a suitable telemetry unit 188, such as a mud pulse telemetry device that includes a pulser for generating pressure pulses; and a system for detecting flow-off states and for using the residual power to perform certain selected functions or operations during such flow-off states, as described in more detail in reference to FIGS. 2-3. Any other telemetry system or technique may also be used, including, but not limited to, electromagnetic telemetry, acoustic telemetry and wired pipe. Such telemetry techniques are known in the art and are thus not described herein in detail. Stabilizers, such as stabilizers 162 and 164 are provided along the steering section 150 to stabilize the steering section. Additional stabilizers, such as stabilizer 166, may be used to stabilize the drilling assembly 130. The controller 170 may include a processor 172, such as a microprocessor, a data storage or memory system 174 and a program 176 accessible to the processor 172. The memory system 174 may include a main or central memory for the drilling assembly 120 and other memories associated with certain selected tools or devices. A common bus, as described later, may be utilized for data transfer among various devices and the controllers 170 and 190. Controller 170 communicates with the controller 190 to control various functions and operations of the tools and devices in the drilling assembly 130.

FIG. 2 is a block diagram showing main components of a drilling assembly 200 that includes a power and telemetry sub or unit 205 according to one non-limiting embodiment of the disclosure. The drilling assembly 200 is shown to include a common or main bus 215 for data transfer among various tools and sensors in the drilling assembly 200. The drilling assembly 200 includes tools 210 that may include devices such as a mud motor, bearing assembly, a steering device and sensors for providing information about drilling parameter, including, but not limited to drilling direction, vibration, stick-slip, rate of penetration, and weight on bit. One or more control circuits 214 coupled to the bus 215 control the operations of the various tools 210. The drilling assembly 200 also is shown to include additional tools 220 that may include a variety of logging-while-drilling tools for providing information about the formation surrounding the drilling assembly 200, including, but not limited to, a resistivity tool, a nuclear tool, an acoustic tool, a nuclear magnetic resonance tool and a gamma ray tool. Tool electronics and control circuits 224 coupled to the bus 215 control operations of the tools 220. A bus controller 225 controls information on the main bus 215, including, but not limited to handling and prioritizing bus information and data. The bus controller 225 may be a microprocessor-based system. The drilling assembly 200 may further include a central memory 230 and may also include other local memory units associated with selected tools.

Still referring to FIGS. 1-2, the drilling assembly 200, the power and telemetry unit or sub 205 generates power, detects the occurrence of flow-off states, estimates the flow-off state period, estimates power available during the flow-off states, manages power distribution or utilization during the flow-off states, cuts off power to tools that do not need to be operated during the flow-off states, causes memory devices to complete their respective write cycles, parks selected tools or devices at their respective desired positions or states, performs other selected functions in a priority manner and communicates with the surface controller 190. For power generation, the sub 205 may include a turbine 250 that is operated by the flow of the drilling fluid 179 through the drilling assembly 200, a clutch 252 coupled to the turbine that drives an alternator 254 and power generator 256 that provides DC current. A bus power supply 258 coupled to the power generator 256 supplies fixed voltage to the bus controller 225 via a bus 260. In addition, a local power supply 262 may be provided for the bus controller 225. The sub 205 may further include a telemetry system that includes a pulser 270 that generates pressure pulses for a mud pulse telemetry system. The pulser 270 is operated by a pulser actuator 272 receives power from a power inverter 274 coupled to the power generator 256. The bus controller 225 controls the operation of the pulser 270 to generate pressure pulses of desired durations and at desired frequencies.

With respect to the early detection of a flow-off state, the power and telemetry sub 205, in one non-limiting embodiment, includes a detection circuit or logic 280. The detection circuit 280 detects the occurrence of flow-off states (also referred to herein as the "early detection" of the flow-off states). The detection logic 280 may determine the early detection by any suitable method, including, but not limited to, detection of the change in speed of the turbine 250 and/or speed of the alternator 254 and/or the output of the active rectifier 257. In one aspect, a sensor 255 may be mounted on the alternator 254 to provide the rotational speed of the alternator. The combination of mud and turbine properties enables early and accurate detection of the flow-off state and can provide clear differentiation from any mud pulse signals sent from the surface, sometimes referred to as the downlink signals. The remaining power in the mud system can be utilized for a safe power down of devices.

The system herein performs dynamic measurement of available power during a flow—off state. In one non-limiting embodiment, the power and telemetry unit 205 includes a circuit or logic 280 for determining or estimating the duration of the flow-off state and the power available during such flow-off state. In one such method, a logic 280 includes a model that may determine the time remaining between detection of the flow off state and the complete shut down and the residual power for use during such time period. In one embodiment, the remaining time and the residual power is determined using laboratory data obtained for different mud weights, mud flow rates, turbine speeds and pulser positions for an unpowered pulser. Such data is stored in the form of look-up tables in a downhole memory accessible to the controller 225. In aspects, upon detection of a flow-off state, the above-noted parameters are measured downhole and using the look-up table, the remaining time and the maximum residual power is determined. In practice, the system continually or constantly may monitor the power use or characteristics of various devices in the drilling assembly 130. Thus, the actual power being used at the flow-off detection time can be known. The constant monitoring of power characteristics of the various devices in conjunction with the calculated residual power and remaining time allows dynamic management or budgeting of the residual power to perform selected operations (also referred to as functions or tasks) during the flow-off state. The calculation of the maximum power available during a flow-off state eliminates any unexpected shutdowns of tools or devices prior to reaching the limit of the residual power.

Still referring to FIGS. 1-2, during drilling of a wellbore, the power generator 256 generates power in response to the flow of the drilling fluid 179 through the drilling assembly 200 and such power is utilized to operate all electrical devices and circuits in the drilling assembly 200. In one embodiment, power also may be stored in a storage device 286, such as a capacitor. When flow of the drilling fluid 179 is stopped at the surface, the detection circuit 280 detects the flow-off state as described above. FIG. 3 shows an exemplary flow chart 300 relating to various actions taken upon the detection of a flow-off state 310. Referring to FIGS. 2 and 3, in one non-limiting embodiment, the power generator 256 generates a flow-off state signal 322 at box 320. The signal 322 is routed at decision box 330 in parallel or simultaneously to one or more of: (i) all memory devices (box 334), including the central memory 230 to cause such memory devices to complete their respective write cycles (box 335). Such an action ensures proper storage of any data that is pending for storage. In parallel, the signal 322 is routed to devices that need to perform a particular function or operation prior to cut off of power generation, i.e., by the use of the residual power generated during the flow-off state. Flow chart 300 shows the pulser 270 to be one such device. A pulser, as is known in the art, includes a rotor that oscillates or rotates to open and close a valve through which the drilling fluid flows to generate pressure pulses. If the pulser is in a closed position, then during tripping of the drilling assembly, the closed pulser prevents the drilling fluid to flow below the pulser and causes the drilling fluid inside the pipes being pulled up to spill on the drilling rig. For such a pulser, it is desirable to cause it to park in the open position to allow the fluid in the drilling assembly to flow downhole during tripping. In the flow chart 300, signal 322 sent to the pulser causes it to park in an open position. Signal 322 also may be used to cause any other device to perform a desired function. As shown in box 340, signal 322 is also sent to the bus controller 225, which disconnects power to other tools to prevent the use of the residual power by such tools upon the detection of the flow-off state.

Thus, in aspects, the disclosure provides a downhole tool with optimized power utilization during flow-off states without the use of batteries downhole. The system includes apparatus and models or programs that detect flow-off states and utilize available energy (residual energy generated during a flow-off state and energy stored in other subsystems, such as a capacitor) for a controlled power down of various tools, completion of memory writing cycles and parking devices at their desired positions. In one aspect, the system described herein may utilize a distinct power down scheme or procedure in a priority manner that ensures finalization of communication to various tools and devices and completion of memory tasks during flow-off states. Such a system can: (i) ensure that data which was collected directly before commencement of a flow-off state is assigned correctly and completely stored; (ii) avoid memory corruption and enables accurate data transmission after power is again generated; (iii) and provide verification of the proper storage of the collected data.

The foregoing disclosure is directed to certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A drilling assembly for use in drilling of a wellbore, comprising:

a controller configured to:

operate a detection logic to detect occurrence of a flow-off state and determine a residual power upon occurrence of the flow-off state; and perform a selected operation in response to the detection of the flow-off state using the residual power stored in a subsystem of the drilling assembly without use of downhole battery power.

2. The drilling assembly of claim 1, wherein the controller operates the detection logic to detect device detects the occurrence of the flow-off state by detecting a speed of a turbine associated with a power generator.

3. The drilling assembly of claim 1, wherein the controller operates the detection logic to detect the occurrence of the flow-off state by detecting a downhole parameter selected from a group consisting of: speed of an alternator associated with a power generator; an output of a rectifier associated with a power generator; and a rotational position sensor associated with an alternator associated with a power generator.

4. The drilling assembly of claim 1, wherein the controller sends a signal to a memory associated with the drilling assembly to store data in response to the detection of the flow-off state.

5. The drilling assembly of claim 1, wherein performing the selected operation further comprises parking a pulser at a desired position.

6. The drilling assembly of claim 5, wherein the desired position is an open position.

7. The drilling assembly of claim 1, further comprising a power generator that generates power in response to flow of a fluid through the drilling assembly.

8. The drilling assembly of claim 7, wherein the controller operates the detection logic to determine the residual power using data obtained for different mud weights, mud flow rates, turbine speeds or pulser positions for an unpowered pulser.

9. The drilling assembly of claim 1, wherein the controller, in response to the detection of the flow-off state, performs at least one of:

(i) shutting down at least one device in the drilling assembly;

(ii) causing a memory to store data; and (iii) parking another device in a desired position.

10. A method of drilling a wellbore, comprising:

conveying a drill string having a drilling assembly from a surface location into the wellbore, wherein the drilling assembly includes a generator that generates power in response to flow of a fluid through the drilling assembly;

stopping the flow of the fluid at the surface;

detecting downhole occurrence of a flow-off state;

determining a residual power upon occurrence of the flow-off state;

performing a selected operation downhole in response to the detection of the flow-off state using the residual power stored in a subsystem of the drilling assembly without use of downhole battery power.

11. The method of claim 10, further comprising detecting the occurrence of the flow-off state by detecting a speed of a turbine associated with a power generator.

12. The method of claim 10, further comprising detecting the occurrence of the flow-off state by detecting a downhole parameter selected from a group consisting of: speed of an alternator associated with a power generator; an output of a rectifier associated with a power generator; and a rotational position sensor associated with an alternator associated with a power generator.

13. The method of claim 10, further comprising sending a signal in response to the detection of the flow-off state to a memory associated with the drilling assembly to store data during the flow-off state.

14. The method of claim 10, further comprising parking a pulser at a desired position in response to the detection of the flow-off state.

15. The method of claim 14, wherein the desired position is an open position.

16. The method of claim 15, further comprising determining the residual power in response to the detection of the flow-off state using data obtained for different mud weights, mud flow rates, turbine speeds or pulser positions for an unpowered pulser.

17. The method of claim 16, further comprising using the residual power to: (i) cause a memory to store data; or (ii) park a device at a desired position.

18. The drilling assembly of claim 1, wherein the subsystem of the drilling assembly is a downhole capacitor.

* * * * *